US009301353B2

(12) United States Patent
Park et al.

(10) Patent No.: US 9,301,353 B2
(45) Date of Patent: Mar. 29, 2016

(54) LIGHT EMITTING DIODE DRIVING APPARATUS

(71) Applicant: SAMSUNG ELECTRO-MECHANICS CO., LTD., Suwon-Si, Gyeonggi-Do (KR)

(72) Inventors: Deuk Hee Park, Suwon-Si (KR); Sang Hyun Cha, Suwon-Si (KR); Yun Joong Lee, Suwon-Si (KR)

(73) Assignee: SOLUM CO., LTD, Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/262,390

(22) Filed: Apr. 25, 2014

(65) Prior Publication Data

US 2015/0115819 A1 Apr. 30, 2015

(30) Foreign Application Priority Data

Oct. 31, 2013 (KR) ..... 10-2013-0131561

(51) Int. Cl.
*G05F 1/00* (2006.01)
*H05B 33/08* (2006.01)

(52) U.S. Cl.
CPC ..... *H05B 33/0815* (2013.01); *H05B 33/08* (2013.01)

(58) Field of Classification Search
CPC ..... H05B 37/02
USPC ..... 315/291, 307, 294, 295, 297, 312, 315/185 R, 200 R, 209 R
See application file for complete search history.

(56) References Cited

U.S. PATENT DOCUMENTS

| | | | | |
|---|---|---|---|---|
| 4,937,441 | A | 6/1990 | Ishizawa et al. | |
| 7,081,722 | B1 | 7/2006 | Huynh et al. | |
| 8,324,840 | B2 * | 12/2012 | Shteynberg et al. | 315/308 |
| 2006/0256050 | A1 | 11/2006 | Ikeda | |
| 2007/0001995 | A1 | 1/2007 | Lee | |
| 2011/0273103 | A1 | 11/2011 | Hong | |
| 2013/0027107 | A1 | 1/2013 | Nohara | |
| 2013/0069546 | A1 * | 3/2013 | Lin et al. | 315/186 |
| 2013/0169160 | A1 * | 7/2013 | Kim et al. | 315/122 |
| 2013/0200802 | A1 * | 8/2013 | Sakuragi et al. | 315/122 |
| 2014/0184078 | A1 * | 7/2014 | Hwang et al. | 315/122 |

FOREIGN PATENT DOCUMENTS

| | | | |
|---|---|---|---|
| DE | 38 36 792 | A1 | 5/1989 |
| EP | 1 087 506 | A2 | 3/2001 |
| EP | 2 645 819 | A1 | 10/2013 |
| EP | 2 680 417 | A1 | 1/2014 |

(Continued)

OTHER PUBLICATIONS

Korean Notice of Office Action issued in corresponding Korean Patent Application No. 10-2013-0131561, mailed on Feb. 25, 2015; 8 pages with English translation.

(Continued)

*Primary Examiner* — Minh D A
(74) *Attorney, Agent, or Firm* — McDermott Will & Emery LLP

(57) ABSTRACT

A light emitting diode driving apparatus may include: a light emitting diode emitting light by receiving rectified power; a driver driving the light emitting diode based on a voltage level of the rectified power; and a controller limiting an operation of the driver based on a voltage applied to the driver and a hysteresis reference value.

15 Claims, 3 Drawing Sheets

(56) References Cited

FOREIGN PATENT DOCUMENTS

| | | | |
|---|---|---|---|
| JP | 2006-319057 | A | 11/2006 |
| KR | 2001-0050573 | A | 6/2001 |
| KR | 10-0997050 | B1 | 11/2010 |
| KR | 10-2013-0017553 | A | 2/2013 |
| KR | 10-2013-0095117 | A | 8/2013 |

OTHER PUBLICATIONS

European Search Report issued in corresponding European Patent Application No. 14275096.7 on Mar. 15, 2015; 4 pages in English language.

* cited by examiner

LIGHT EMITTING DIODE DRIVING APPARATUS

CROSS-REFERENCE TO RELATED APPLICATION

This application claims the benefit of Korean Patent Application No. 10-2013-0131561 filed on Oct. 31, 2013, with the Korean Intellectual Property Office, the disclosure of which is incorporated herein by reference.

BACKGROUND

The present disclosure relates to a light emitting diode (LED) driving apparatus capable of driving a light emitting diode directly, using alternating current (AC) power.

Light emitting diodes (LEDs), a semiconductor devices having a p-n junction structure and emitting light through the recombination of electrons and holes, has recently been applied to various technological fields in accordance with the development of semiconductor technology. Particularly, since LEDs have higher degrees of efficiency, longer effective lifespans and are more environment-friendly than existing light emitting devices, fields to which LEDs are applied have continuously increased.

Generally, LEDs are driven by direct current (DC) power having a level of several volts applied thereto in view of a structure thereof. Therefore, generally, in order to drive LEDs with commercially available alternating current (AC) power used domestically, commercially or industrially, a separate unit is required. In order to drive an LED with commercial AC power, an LED driving apparatus generally includes a rectifying circuit, an AC to DC converter, and the like.

However, since a general AC to DC converter has a relatively large volume and consumes a significant amount of power, when such a general AC to DC converter is used, advantages of LEDs such as high efficiency, a small packaging size, a long lifespan, and the like, are offset.

Therefore, a large amount of research into apparatuses capable of driving LEDs directly with AC power, without the need for an AC to DC converter, has recently been undertaken.

In an AC direct driving type LED driving circuit in which an LED is directly driven with AC power, a smoothing capacitor is not used, such that the LED driving circuit has advantages in terms of a lifespan, a size, and the like.

In the case of driving an LED directly with AC power, without the use of an AC to DC converter, a plurality of switches are connected to a plurality of LEDs, respectively, and corresponding LED groups are driven while being turned on or off depending on a level of the AC power. That is, an AC direct driving type LED driving circuit may control the LED groups to be automatically turned on or off depending on a change in an AC power voltage.

Meanwhile, in the AC direct driving type LED driving apparatus, a flicker phenomenon may occur due to noise in an AC power voltage at a boundary at which the number of LED groups that are turned on is changed.

Patent Documents 1 to 6, listed below, do not disclose a configuration for preventing a flicker phenomenon due to noise in an AC power voltage at a boundary at which the number of LED groups that are turned on is changed.

RELATED ART DOCUMENT (Patent Document 1) Korean Patent No. 10-0997050
(Patent Document 2) Korean Patent Laid-Open Publication No. 2013-0017553

SUMMARY

An aspect of the present disclosure may provide an alternating current (AC) direct driving type light emitting diode (LED) driving apparatus capable of preventing a flicker phenomenon that may occur at a boundary at which the number of LED groups that are turned on is changed.

According to an aspect of the present disclosure, a light emitting diode driving apparatus may include: a light emitting diode emitting light by receiving rectified power; a driver driving the light emitting diode depending on a voltage level of the rectified power; and a controller limiting an operation of the driver based on a voltage applied to the driver and a hysteresis reference value.

The driver may include: a driving comparator comparing a detection voltage based on a current flowing in the light emitting diode with a light emitting reference voltage; and a control switch switched based on a comparison result of the driving comparator to control the light emitting diode.

The control switch may be connected to a cathode of the light emitting diode.

The control switch may be a field effect transistor (FET).

The controller may limit the operation of the driver based on a drain voltage of the control switch and the hysteresis reference value.

The controller may turn on the control switch in the case in which the level of the drain voltage of the control switch is higher than the hysteresis reference value and turn off the control switch in the case in which the drain voltage of the control switch has a level lower than that of the hysteresis reference value.

The controller may include: a limiting comparator comparing the drain voltage of the control switch with the hysteresis reference value; and a hysteresis switch connecting an output of the driving comparator to a ground based on a comparison result of the limiting comparator.

The hysteresis switch may be a FET, and a drain of the hysteresis switch may be connected to the output of the driving comparator.

The controller may include: a limiting comparator comparing a cathode terminal voltage of the light emitting diode with the hysteresis reference value; and a hysteresis switch controlling a connection between the light emitting diode and the control switch based on a comparison result of the limiting comparator.

The hysteresis switch may be connected between the light emitting diode and the control switch.

The light emitting diode driving apparatus may further include a rectifying unit rectifying alternating current (AC) power and supplying the rectified power to the light emitting diode.

According to another aspect of the present disclosure, a light emitting diode driving apparatus may include: a light emitting diode unit including a plurality of light emitting diodes connected to one another in series, each of the plurality light emitting diodes emitting light by receiving rectified power; a driving unit including a plurality of drivers driving the plurality of light emitting diodes, respectively, based on a voltage level of the rectified power; and a controlling unit limiting operations of the respective drivers based on voltages applied to the respective drivers and a hysteresis reference value.

Each of the plurality of drivers may include: a driving comparator comparing a detection voltage depending on a current flowing in the light emitting diode with a light emitting reference voltage; and a control switch switched based on a comparison result of the driving comparator to control the light emitting diode.

The light emitting reference voltages of each of the plurality of drivers may be different from one another.

The control switch of each of the plurality of drivers may be connected to a cathode of a corresponding light emitting diode.

The control switch may be a FET.

The controlling unit may include a plurality of controllers limiting the operations of the respective drivers based on drain voltages of the respective control switches and the hysteresis reference value.

The controlling unit may turn on the control switch in the case in which the level of the drain voltage of the control switch is higher than the hysteresis reference value and turn off the control switch in the case in which the drain voltage of the control switch has a level lower than that of the hysteresis reference value.

The controlling unit may include: a plurality of limiting comparators comparing the drain voltages of the control switches with the hysteresis reference value, respectively; and a plurality of hysteresis switches connecting outputs of the driving comparators to a ground based on comparison results of the plurality of limiting comparators, respectively.

The plurality of hysteresis switches may be FETs, and drains of the plurality of hysteresis switches may be connected to the outputs of the plurality of driving comparators, respectively.

The light emitting diode driving apparatus may further include a rectifying unit rectifying AC power and supplying the rectified power to the light emitting diode.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
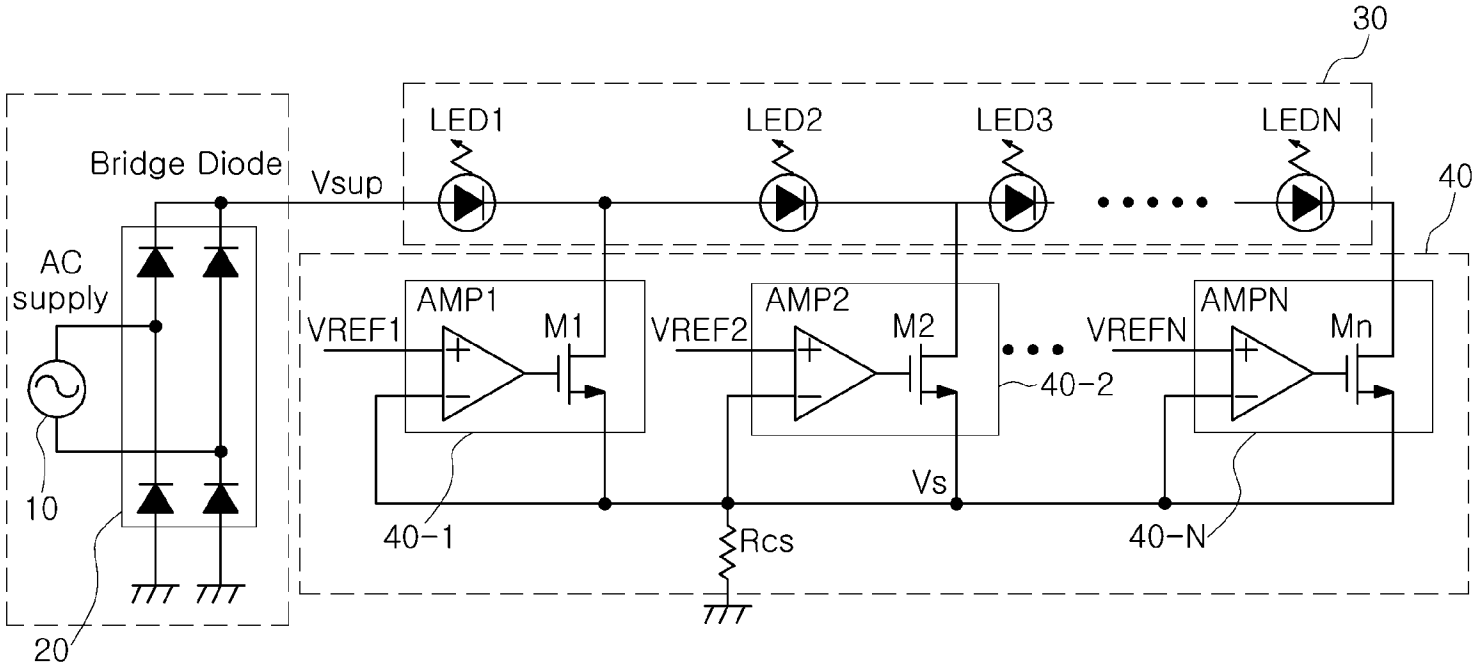
FIG. 1 is a view showing an alternating current (AC) direct driving type light emitting diode (LED) driving apparatus.

Hereinafter, embodiments of the present disclosure will be described in detail with reference to the accompanying drawings. The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. Throughout the drawings, the same or like reference numerals will be used to designate the same or like elements.

FIG. 1 is a view showing an alternating current (AC) direct driving type light emitting diode (LED) driving apparatus.

Referring to FIG. 1, the AC direct driving type light emitting diode driving apparatus may include a power supplying unit 10, a rectifying unit 20, a light emitting diode unit 30, and a driving unit 40.

The power supplying unit 10 may supply AC power.

The rectifying unit 20 may receive the AC power, full-wave or half-wave rectify the received AC power, and supply the rectified power to the light emitting diode unit 30 to provide power capable of allowing the light emitting diode unit 30 to emit light.

The light emitting diode unit 30 may include a plurality of light emitting diodes LED1, LED2, . . . , LEDN connected to one another in series, and a corresponding light emitting diode may perform a light emitting operation by the driving unit 40.

The driving unit 40 may drive each of the plurality of light emitting diodes LED1, LED2, . . . , LEDN of the light emitting diode unit 30. To this end, the driving unit 40 may include a plurality of drivers 40-1, 40-2, . . . , 40-N.

Each of the first to N-th drivers 40-1 to 40-N may be in charge of first to N-th light emitting diodes LED1 to LEDN of the light emitting diode unit 30 to drive a corresponding light emitting diode.

In more detail, the first driver 40-1 may be in charge of driving of the first diode LED1. In addition, when a voltage level of the power rectified by the rectifying unit 20 rises, an operation of the first driver 40-1 may be stopped, the second driver 40-2 may be in charge of driving of the first and second diodes LED1 and LED2, the third driver 40-3 to N−1-th driver 40-N−1 may be sequentially operated, and the N-th driver 40-N may be in charge of driving of the first to N-th light emitting diodes LED1 to LEDN.

Here, for example, in the case in which a voltage for driving the first and second diodes LED1 and LED2 is 90V, when the rectifying unit 20 provides a voltage of 90V, a flicker phenomenon that the second diode LED2 flickers due to noise may occur.

For convenience of explanation, a minimum voltage value for driving the first diode LED1 will be defined as a first boundary voltage. Likewise, a minimum voltage value for driving the second diode LED2 will be defined as a second boundary voltage. In addition, a minimum voltage value for driving the N-th diode will be defined as an N-th boundary voltage.

In the case in which the rectifying unit 20 provides the first boundary voltage, a flicker phenomenon may occur in the first diode due to noise. Likewise, in the case in which the rectifying unit 20 provides the second boundary voltage, a flicker phenomenon may occur in the second diode due to noise.

Therefore, each diode needs to be turned on at a voltage sufficiently larger than a boundary voltage in consideration of the noise.

Figure 2:
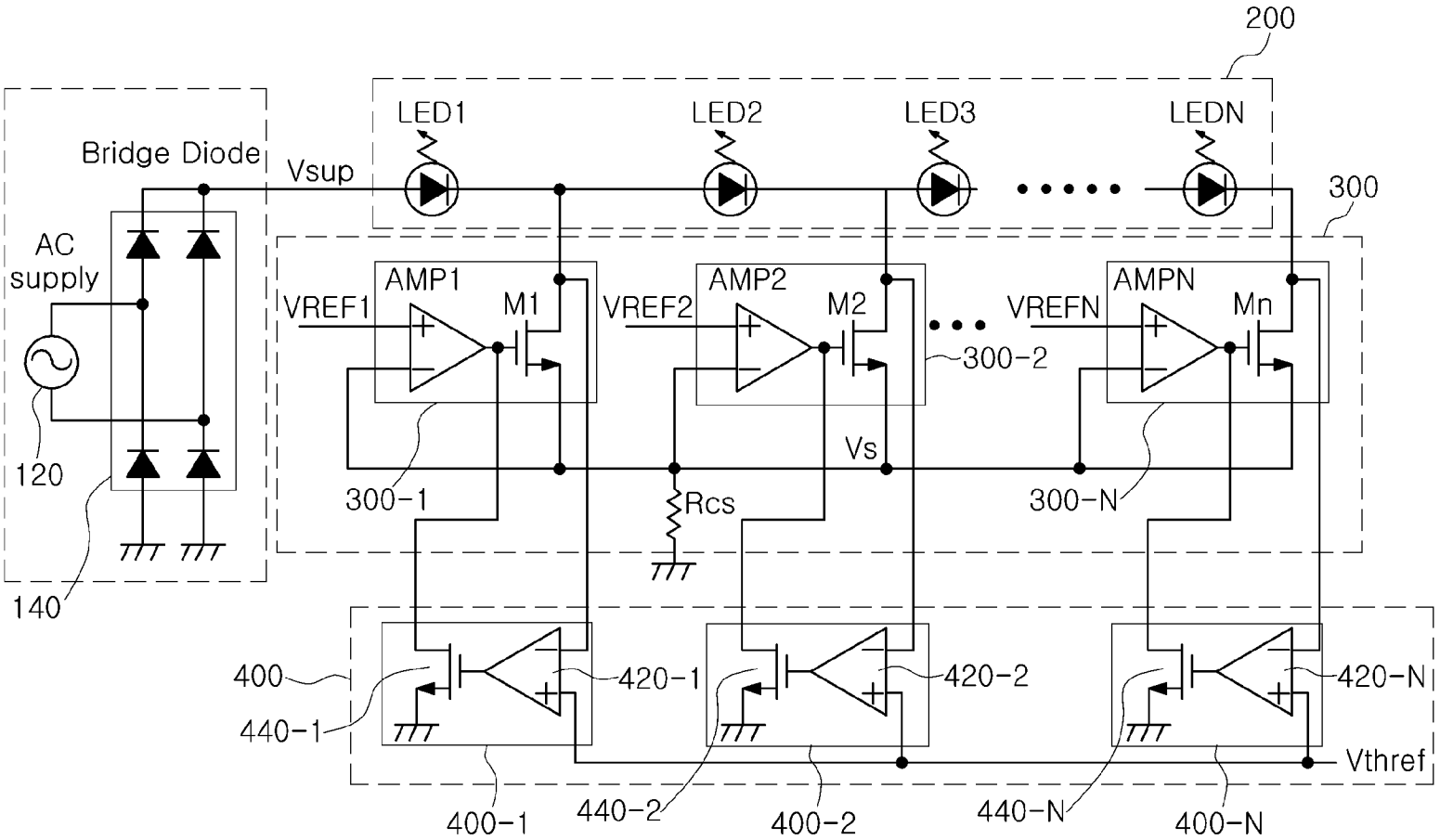
FIG. 2 is a view showing a light emitting diode driving apparatus according to an exemplary embodiment of the present disclosure.

FIG. 2 is a view showing a light emitting diode driving apparatus according to an exemplary embodiment of the present disclosure.

Referring to FIG. 2, the light emitting diode driving apparatus may include a power supplying unit 120, a rectifying unit 140, a light emitting diode unit 200, a driving unit 300, and a controlling unit 400.

The power supplying unit 120 may supply AC power.

The rectifying unit 140 may receive the AC power, full-wave or half-wave rectify the received AC power, and supply the rectified power to the light emitting diode unit 200 to provide power capable of allowing light emitting diodes LED1 to LEDN to emit light.

The light emitting diode unit 200 may include a plurality of light emitting diodes LED1, LED2, . . . , LEDN connected to each other in series, and a corresponding light emitting diode may perform a light emitting operation by the driving unit 300.

The driving unit 300 may drive each of the plurality of light emitting diodes LED1, LED2, . . . , LEDN of the light emitting diode unit 200. To this end, the driving unit 300 may include a plurality of drivers 300-1, 300-2, . . . , 300-N.

Each of the first to N-th drivers 300-1, 300-2, . . . , 300-N may be in charge of first to N-th light emitting diodes LED1 to LEDN of the light emitting diode unit 200 to drive a corresponding light emitting diode.

In more detail, the first driver 300-1 may be in charge of driving of the first diode LED1. In addition, when a voltage level of the power rectified by the rectifying unit 140 rises, an operation of the first driver 300-1 may be stopped, the second driver 300-2 may be in charge of driving of the first and second diodes LED1 and LED2, the third driver 300-3 to N−1-th driver 40-N−1 may be sequentially operated, and the N-th driver 300-N may be in charge of driving of the first to N-th light emitting diodes LED1 to LEDN.

That is, each of the first to N-th drivers 300-1, 300-2, . . . , 300-N may drive the first to N-th light emitting diodes LED1 to LEDN corresponding thereto based on a voltage level of the rectified power. For example, in the case in which power rectified by the rectifying unit 140 is the first boundary voltage or more, the first light emitting diode LED1 may be turned on. In addition, in the case in which power rectified by the rectifying unit 140 is the second boundary voltage or more, the first and second light emitting diodes LED1 and LED2 may be turned on.

Referring to FIG. 2, the first driver 300-1 may include a first driving comparator AMP1 and a first control switch M1.

In detail, the first driving comparator AMP1 may compare a detection voltage depending on a current flowing in the first light emitting diode LED1 with a light emitting reference voltage VREF1.

The first control switch M1 may be connected to a cathode of the first light emitting diode LED1. In addition, the first control switch M1 may be a field effect transistor (FET).

The first control switch M1 may be switched based on a comparison result of the first driving comparator to control the first light emitting diode LED1.

In the case in which the detection voltage has a level lower than that of the light emitting reference voltage VREF1, the first control switch M1 may be maintained in a turn-on state.

In the case in which the detection voltage is increased to thereby become larger than the light emitting reference voltage VREF1, the first control switch M1 may be turned off. In this case, any one of second to N-th control switches M2 to Mn may be turned on based on an increase amount in the detection voltage.

Meanwhile, light emitting reference voltages VREF1 to VREFN of each of the plurality of drivers may be different from each other.

The controlling unit 400 may limit operations of the respective drivers 300-1 to 300-N based on voltages applied to the respective drivers 300-1 to 300-N and a hysteresis reference value Vthref.

The hysteresis reference value Vthref may mean a margin voltage for driving a light emitting diode while prevent flicker due to noise. That is, a predetermined light emitting diode may emit light only in the case in which a voltage of the hysteresis reference value or more is additionally applied thereto.

The controlling unit 400 may include a plurality of controllers 400-1 to 400-N.

In detail, the first controller 400-1 may limit an operation of the first driver 300-1 based on a voltage applied to the first driver 300-1 and the hysteresis reference value Vthref.

In the case in which the first control switch M1 is implemented by the first field effect transistor, the voltage applied to the first driver 300-1 may be a drain voltage of the first control switch M1.

The first controller 400-1 may turn on the first control switch M1 in the case in which the drain voltage of the first control switch M1 has a level higher than that of the hysteresis reference value Vthref. In addition, the first controller 400-1 may maintain the first control switch M1 in a turn-off state in the case in which the drain voltage of the first control switch M1 has a level lower than that of the hysteresis reference value Vthref.

In detail, the first controller 400-1 may include a first limiting comparator 420-1 and a first hysteresis switch 440-1.

Meanwhile, for convenience of explanation, a comparator used in the driving unit 300 will be defined as a driving comparator, and a comparator used in the controlling unit 400 will be defined as a limiting comparator.

The first limiting comparator 420-1 may compare the drain voltage of the first control switch M1 with the hysteresis reference value Vthref.

The first hysteresis switch 440-1 may connect an output of the first driving comparator AMP1 to a ground based on a comparison result of the first limiting comparator 420-1. In detail, the first hysteresis switch 440-1 may be afield effect transistor, and a drain thereof may be connected to the output of the first driving comparator AMP1.

Therefore, the first limiting comparator 420-1 may turn on the first hysteresis switch 440-1 in the case in which the drain voltage of the first control switch M1 has a level lower than that of the hysteresis reference value Vthref. The hysteresis switch 440-1 is turned on, such that the driving of the first control switch M1 may be limited.

The first limiting comparator 420-1 may turn off the first hysteresis switch 440-1 in the case in which the drain voltage of the first control switch M1 has a level higher than that of the hysteresis reference value Vthref. The hysteresis switch 440-1 is turned off, such that the limitation of the driving of the first control switch M1 may be released.

Meanwhile, the controlling unit 400 may include a second controller 400-2 corresponding to the second driver 300-2, a third controller 400-3 corresponding to the third driver 300-3, and an N-th controller 400-N corresponding to the N-th driver 300-N.

In this scheme, in the case in which a voltage applied to a drain of a predetermined control switch is sufficiently large, a corresponding light emitting diode is conducted, whereby the flicker phenomenon due to the noise may be prevented.

For example, in the case in which the second boundary voltage is 90V, the second light emitting diode LED 2 may be turned on only when the voltage supplied by the rectifying unit 140 is 90+Vthref V or more.

In addition, the limiting comparator 420 according to an exemplary embodiment of the present disclosure may have hysteresis characteristics. Since the limiting comparator 420 has the hysteresis characteristics, in the case in which the limitation of the driving by the controlling unit 400 is released, reoccurrence of the flicker phenomenon may be prevented.

Figure 3:
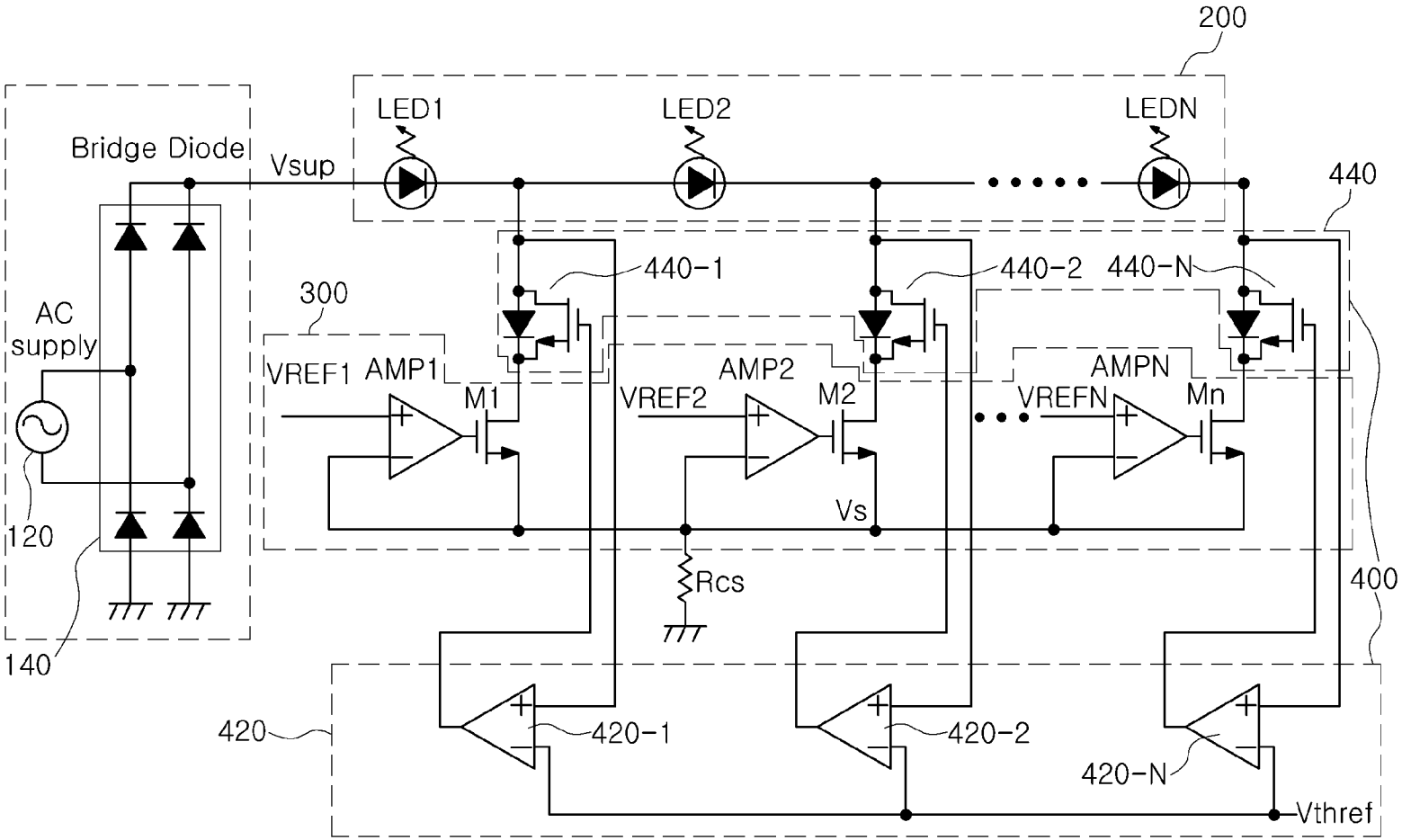
FIG. 3 is a view showing a light emitting diode driving apparatus according to another exemplary embodiment of the present disclosure.

FIG. 3 is a view showing a light emitting diode driving apparatus according to another exemplary embodiment of the present disclosure.

Referring to FIG. 3, the light emitting diode driving apparatus according to another exemplary embodiment of the present disclosure is different in a configuration of a controlling unit 400 from the light emitting diode driving apparatus according to an exemplary embodiment of the present disclosure shown in FIG. 2. Since configurations other than the controlling unit 400 are the same as those of the light emitting diode driving apparatus according to an exemplary embodiment of the present disclosure shown in FIG. 2, a detailed description thereof will be omitted.

Referring to FIG. 3, a first controller may include a first limiting comparator 420-1 and a first hysteresis switch 440-1.

The first limiting comparator 420-1 may compare a cathode terminal voltage of a corresponding light emitting diode LED1 with the hysteresis reference value Vthref.

The first hysteresis switch 440-1 may control a connection between the light emitting diode LED1 and the first control switch M1 based on a comparison result of the first limiting comparator 420-1.

In detail, the first hysteresis switch 440-1 may be a field effect transistor, and may be connected between the light emitting diode LED1 and the first control switch M1.

Therefore, the first limiting comparator 420-1 may turn off the first hysteresis switch 440-1 in the case in which the cathode terminal voltage of the light emitting diode LED1 has a level lower than that of the hysteresis reference value Vthref. The hysteresis switch 440-1 is turned off, such that the driving of the first control switch M1 may be limited.

The first limiting comparator 420-1 may turn on the first hysteresis switch 440-1 in the case in which the cathode terminal voltage of the light emitting diode LED1 has a level higher than that of the hysteresis reference value Vthref. The hysteresis switch 440-1 is turned on, such that the limitation of the driving of the first control switch M1 may be released.

Meanwhile, the controlling unit 400 may include a second controller corresponding to the second driver 300-2, a third controller corresponding to the third driver 300-3, and an N-th controller corresponding to the N-th driver 300-N.

As set forth above, according to exemplary embodiments of the present disclosure, the flicker phenomenon that may occur when the number of LED groups that are turned on is changed in the AC direct driving type light emitting diode driving apparatus may be prevented.

While exemplary embodiments have been shown and described above, it will be apparent to those skilled in the art that modifications and variations could be made without departing from the spirit and scope of the present disclosure as defined by the appended claims.

What is claimed is:

1. A light emitting diode driving apparatus comprising:

a light emitting diode emitting light by receiving rectified power;

a driver driving the light emitting diode based on a voltage level of the rectified power; and a controller limiting an operation of the driver based on a voltage applied to the driver and a hysteresis reference value, wherein the driver includes a driving comparator comparing a detection voltage depending on a current flowing in the light emitting diode with a light emitting reference voltage and a control switch switched on in the case in which the detection voltage has a level lower than that of the light emitting reference voltage, and wherein the controller turns on the control switch in the case in which the level of the drain voltage of the control switch is higher than the hysteresis reference value and turns off the control switch in the case in which the drain voltage of the control switch has a level lower than that of the hysteresis reference value.

2. The light emitting diode driving apparatus of claim 1, wherein the control switch is connected to a cathode of the light emitting diode.

3. The light emitting diode driving apparatus of claim 1, wherein the control switch is a field effect transistor (FET).

4. The light emitting diode driving apparatus of claim 1, wherein the controller includes:

a limiting comparator comparing the drain voltage of the control switch with the hysteresis reference value; and a hysteresis switch connecting an output of the driving comparator to a ground based on a comparison result of the limiting comparator.

5. The light emitting diode driving apparatus of claim 4, wherein the hysteresis switch is a FET, and a drain of the hysteresis switch is connected to the output of the driving comparator.

6. The light emitting diode driving apparatus of claim 1, wherein the controller includes:

a limiting comparator comparing a cathode terminal voltage of the light emitting diode with the hysteresis reference value; and a hysteresis switch controlling a connection between the light emitting diode and the control switch based on a comparison result of the limiting comparator.

7. The light emitting diode driving apparatus of claim 6, wherein the hysteresis switch is connected between the light emitting diode and the control switch.

8. The light emitting diode driving apparatus of claim 1, further comprising a rectifying unit rectifying alternating current (AC) power and supplying the rectified power to the light emitting diode.

9. A light emitting diode driving apparatus comprising:

a light emitting diode unit including a plurality of light emitting diodes connected to one another in series, each of the plurality light emitting diodes emitting light by receiving rectified power;

a driving unit including a plurality of drivers driving the plurality of light emitting diodes, respectively, based on a voltage level of the rectified power; and a controlling unit limiting operations of the respective drivers based on voltages applied to the respective drivers and a hysteresis reference value, wherein each of the plurality of drivers includes a driving comparator comparing a detection voltage depending on a current flowing in the light emitting diode with a light emitting reference voltage and a control switch switched on in the case in which the detection voltage has a level lower than that of the light emitting reference voltage, and wherein the controlling unit turns on the control switch in the case in which the level of the drain voltage of the control switch is higher than the hysteresis reference value and turns off the control switch in the case in which the drain voltage of the control switch has a level lower than that of the hysteresis reference value.

10. The light emitting diode driving apparatus of claim 9, wherein the light emitting reference voltages of each of the plurality of drivers are different from one another.

11. The light emitting diode driving apparatus of claim 9, wherein the control switch of each of the plurality of drivers is connected to a cathode of a corresponding light emitting diode.

12. The light emitting diode driving apparatus of claim 9, wherein the control switch is a FET.

13. The light emitting diode driving apparatus of claim 9, wherein the controlling unit includes:

a plurality of limiting comparators comparing the drain voltages of the control switches with the hysteresis reference value, respectively; and a plurality of hysteresis switches connecting outputs of the driving comparators to a ground based on comparison results of the plurality of limiting comparators, respectively.

14. The light emitting diode driving apparatus of claim 13, wherein the plurality of hysteresis switches are FETs, and drains of the plurality of hysteresis switches are connected to the outputs of the plurality of driving comparators, respectively.

15. The light emitting diode driving apparatus of claim 9, further comprising a rectifying unit rectifying AC power and supplying the rectified power to the light emitting diode.

* * * * *